United States Patent [19]

Barker

[11] Patent Number: 4,517,786

[45] Date of Patent: May 21, 1985

[54] METHOD OF AND APPARATUS FOR WRAPPING ARTICLES

[75] Inventor: Jeffrey G. Barker, High Wycombe, England

[73] Assignee: Ranks Hovis McDougall p.l.c., England

[21] Appl. No.: 433,089

[22] Filed: Oct. 6, 1982

[30] Foreign Application Priority Data

Oct. 8, 1981 [GB] United Kingdom ..... 8130389

[51] Int. Cl.[3] ..... B65B 9/10; B65B 7/12; B65B 51/00

[52] U.S. Cl. ..... 53/450; 53/483; 53/550; 53/370; 17/34

[58] Field of Search ..... 53/483, 461, 549, 450, 53/370, 550, 551, 552, 451; 17/34

[56] References Cited

U.S. PATENT DOCUMENTS

| | | | |
|---|---|---|---|
| 1,116,618 | 11/1914 | Page | 53/549 |
| 1,313,234 | 8/1919 | Jones | 53/483 |
| 2,113,078 | 4/1938 | Campbell | 53/549 X |
| 3,001,351 | 9/1961 | Brook et al. | 53/370 |
| 3,307,324 | 3/1967 | Roehm | 53/549 |

*Primary Examiner*—Horace M. Culver

*Attorney, Agent, or Firm*—McCormick, Paulding & Huber

[57] ABSTRACT

Wrapping fragile or easily collapsible articles in foil, for example, aluminium foil by feeding the articles in succession along a track or slideway, forming a tube of foil about the articles, twisting the leading article and its surrounding foil about the main axis of the tube and severing the tube at the twist.

11 Claims, 12 Drawing Figures

Fig. 3.
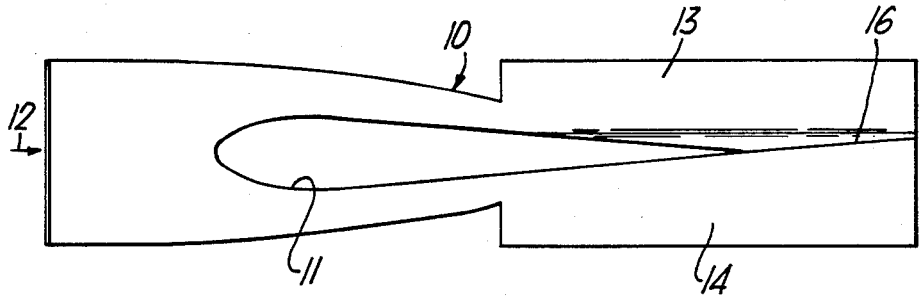
Fig. 4.
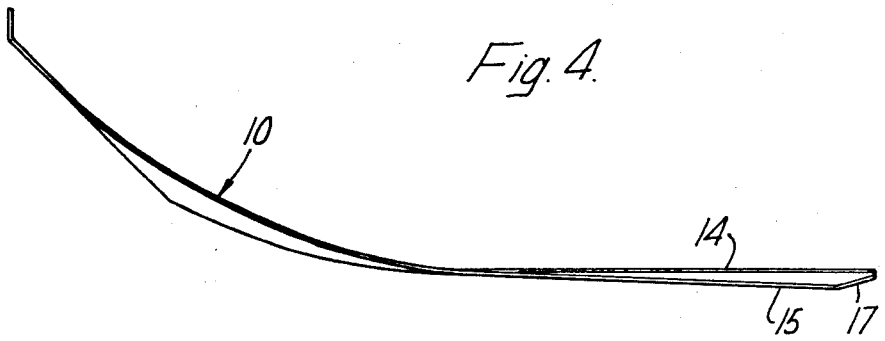
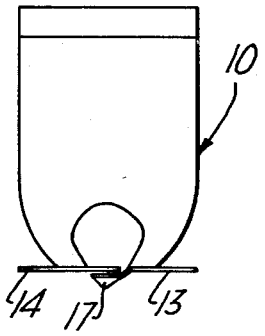
Fig. 5.

52
53
51
43
44
45
38
54
33
VIII
36
VIII
35
50
46
37
39
41
47
48
49
42
40
29
55
VII
30
32
34
31
VII

METHOD OF AND APPARATUS FOR WRAPPING ARTICLES

DESCRIPTION

This invention relates to a method of and apparatus for wrapping fragile or easily collapsible articles in foil.

PRIOR ART

Wrapping machines in general are designed using plastics or metallised plastics film as the wrapping medium, the main advantage of such film being that the wrapping medium is pliable and has sufficient strength to be pulled round and through a folding box or plate to form a tube. It can also be heat sealed and cut by a simple rotary heater and knife. These machines are not usually very complex and offer a smooth flow of product with minimum attention.

However, when it is desired to wrap articles which are easily collapsible, for example chocolate covered rolls, these have by tradition been wrapped in a thin metal foil. Such products cannot be passed through a conventional flow wrapper because the foil does not have sufficient strength to be formed around the square box normally associated with wrapping machines and of course the wrapping cannot be heat sealed. To overcome this problem a machine is employed which has a carousel arrangement and a complexity of cams and fingers to fold the foil around the roll. These machines are expensive to manufacture and maintain and are not always consistent in quality of wrap, particularly with products which may vary in size and shape.

OBJECT OF INVENTION

It is the main object of this invention to provide a method and apparatus for wrapping articles which are fragile or easily collapsed, for example chocolate covered rolls and which uses standard metal foil, in particular, aluminium foil.

STATEMENTS OF INVENTION

According to the present invention there is provided a method of wrapping fragile or easily collapsible articles in foil which includes passing articles in spaced succession along a track, laying foil continuously over the articles to pass along the track therewith, pasing the articles and foil beneath a folding plate which forms the foil into a tube surrounding the articles, feeding the articles and tube to a twisting and severing station at which an article and its surrounding tube portion are rotated about the main axis of the tube to form a twist in the tube between that article and the succeeding article and severing the twist with a knife; and repeating the twisting and severing of the tube between successive articles.

The method also includes conveying the articles and surrounding tube to the twisting and severing station centrally to the track by a pair of resilient belts.

The forward motion of that article and its portion of surrounding tube which has entered the twisting and severing station may be arrested during the twisting and severing operation.

Conveniently the article and surrounding tube portion are moved substantially the length of one article from the twisting to the severing position.

The invention also includes apparatus for wrapping fragile or easily collapsible articles in foil, including a slideway on which articles may be placed, first conveying means associated with the slideway for moving articles in spaced succession there along, a folding plate located adjacent the slideway said plate forming the foil into a tube surrounding the articles as the foil and articles proceed along the slideway, second conveying means for moving the articles and surrounding tube to a twisting means which receives an article and its surrounding tube portion and twists the same about the main axis of the tube to form a twist in the tube between that article and the succeeding twists the same about the main axis of the tube to form a twist in the tube between that article and the succeeding article, severing means which severs the twisted tube and third conveyor means for feeding the articles and surrounding tube from the slideway to the twisting means and severing means.

Conveniently the slideway is a horizontal elongate member with a longitudinal central slot and the first conveyor means for moving articles in succession is a chain of dogs which project through the slot and abut the trailing end of an article; the dogs being carried by a driven endless chain. Conveniently the dogs are pivotally mounted on the chain for retraction.

The second conveying means may be a pair of belts one on each side of the tube said belts having resilient faces which frictionally engage the tube and move the same along the slideway.

The said belts may be urged against the tube by pairs of idler rollers the pairs having one roller on each side of the tube and both rollers in a pair being urged against the tube by a common weight or spring to centralise the tube on the slideway.

Preferably, the folding plate has an upstream profiled opening through which passes the articles together with foil laid continuously over the articles and downstream two lower fingers which overlap to form the foil into a tube surrounding the articles.

The twisting means may comprise a pair of belts one on top and one below the tube when the twisting means is at rest, the belting being mounted in a twisting head and means for index rotation of the twisting head through a complete revolution.

The twisting head may carry a drive mechanism for driving the belts, the said drive mechanism being continuously driven from a prime mover through a sun gear and attendant planet gears to drive the belts, index rotation of the rotating head rotating the planet gears about the periphery of the sun gear whereby effective drive to the belts ceases during indexing.

Preferably the index rotation of the twisting head is achieved by a cam indexer, the cam profile of which has a linear portion substantially at the centre of the index rotation.

The severing means may include a knife and an anvil mounted to move into a severing position from opposite sides of the twisted portion of the tube, the severing being effected during the linear portion of the index rotation.

THE DRAWINGS

The invention will now be described by way of example only and with reference to the accompanying drawings in which one embodiment is illustrated. In the drawings:

FIG. 3 is a plan view of a folding plate which forms part of the apparatus of the invention;

FIG. 4 is a side elevation of the plate of FIG. 3, and

FIG. 5 is an end view of the plate of FIGS. 3 and 4.

DESCRIPTION OF SPECIFIC EMBODIMENT

Figure 1:
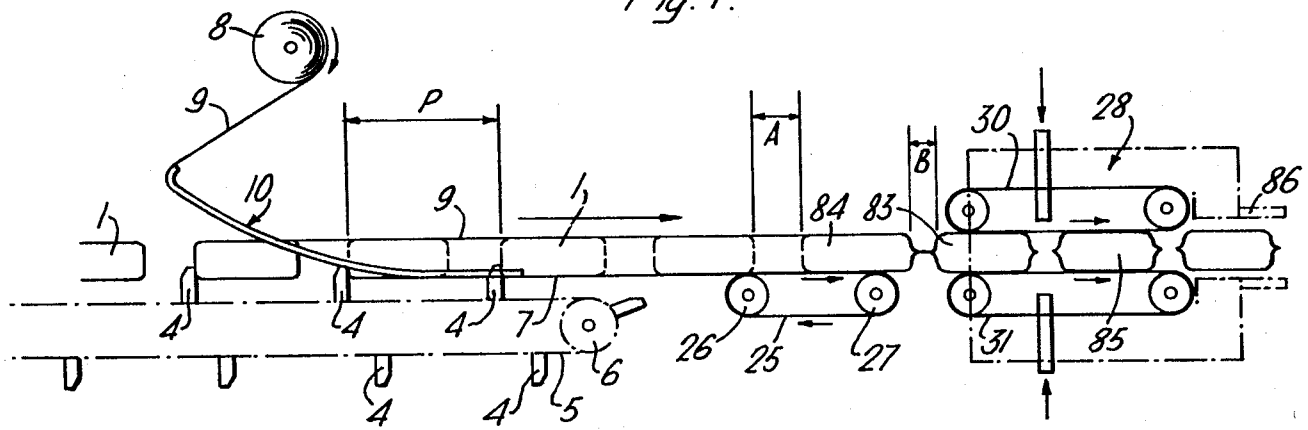
FIG. 1 is a schematic side elevation of apparatus in accordance with the invention.
Figure 2:
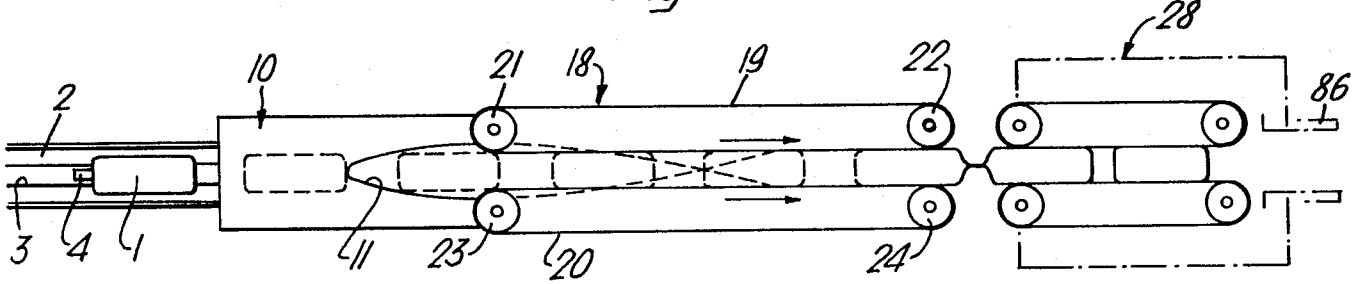
FIG. 2 is a schematic plan view of the apparatus of FIG. 1.

Referring now to the drawings and first of all to the flow diagrams of FIGS. 1 and 2, there is illustrated at 1, a series of small chocolate covered rolls which are to be wrapped in aluminium foil. It will be appreciated that although the invention is specifically described in relation to the wrapping of chocolate covered rolls in aluminium foil, the invention is not limited to the wrapping of such articles, but is directly applicable to the wrapping of any article which is easily compressed and thereby mutilated. These articles 1 are placed on a slideway 2 having a longitudinally extending slot 3 therein. Means are associated with this slideway 2 for conveying the articles 1 along the slideway in succession and this means includes dogs 4 which abut the rear end of each article 1. The dogs 4 are carried by an endless chain 5, driven by pinion 6. The distance between adjacent dogs 4 is adjusted to a set pitch P which is somewhat greater than the length of an article 1. This results in a gap A being left between the end of a leading article and the front end of a succeeding article.

Each of the dogs 4 is pivotally mounted on the chain 5 so that it may be retracted at approximately point 7 along the slideway 2.

A roll 8 of aluminium foil 9 is mounted above the slideway 2 and is guided by a folding plate 10 to lay continuously over the articles 1 as they pass along the slideway 2. The exact shape of the plate 10 is illustrated in FIGS. 3, 4 and 5. Plate 10 is made of metal and has an upstream opening 11 therein, which when viewed in the direction of movement of the articles, namely the direction indicated by arrow 12, is substantially in the shape of a circle. At the downstream end of the plate 10 are two fingers 13 and 14, the inner edge of finger 13 passing slightly under the inner edge 16 of FIG. 14. It will also be noticed that the extreme end of a finger 15 is bent at 17.

The configuration of the plate 10 ensures that as the articles and foil are fed forwardly along the slideway 2, the foil is wrapped round the articles and forms a tube. This tube will be continuous with the longitudinal edges slightly overlapping beneath the articles, conveniently by 0.5 cm.

Prior to the dogs 4 retracting at point 7, the articles and surrounding tube are engaged by second conveying means 18 in the form of a pair of belts 19 and 20, one on each side of the tube. The belt 19 runs over pulleys 21 and 22 and the belt 20 runs over the pulleys 23 and 24 which are driven in the direction of the arrows.

These driven belts 19 and 20 continue the forward motion of the articles and surrounding tube. The belts 19 and 20 have soft foam rubber faces which gently grip the tube, and the inner run of each belt 19 and 20 is urged by idler rollers into frictional contact with the outside of the tube and this ensures centralisation of the articles and tube as they pass along the slideway. The idler rollers are divided into pairs one roller of each pair being behind one of the inner runs of belts. These pairs of idler rollers are connected in such a manner that they have common weights or springs or other mechanisms in order to give an equal inward force to these pairs of weights. This part of the mechanism is not illustrated in the drawings but will be quite apparent from the description.

The tube needs to be supported underneath as soon as the slideway ends and for this purpose a short support belt 25 is provided which is driven and runs over pulleys 26 and 27 and moves in the direction of the arrow.

Figure 7:
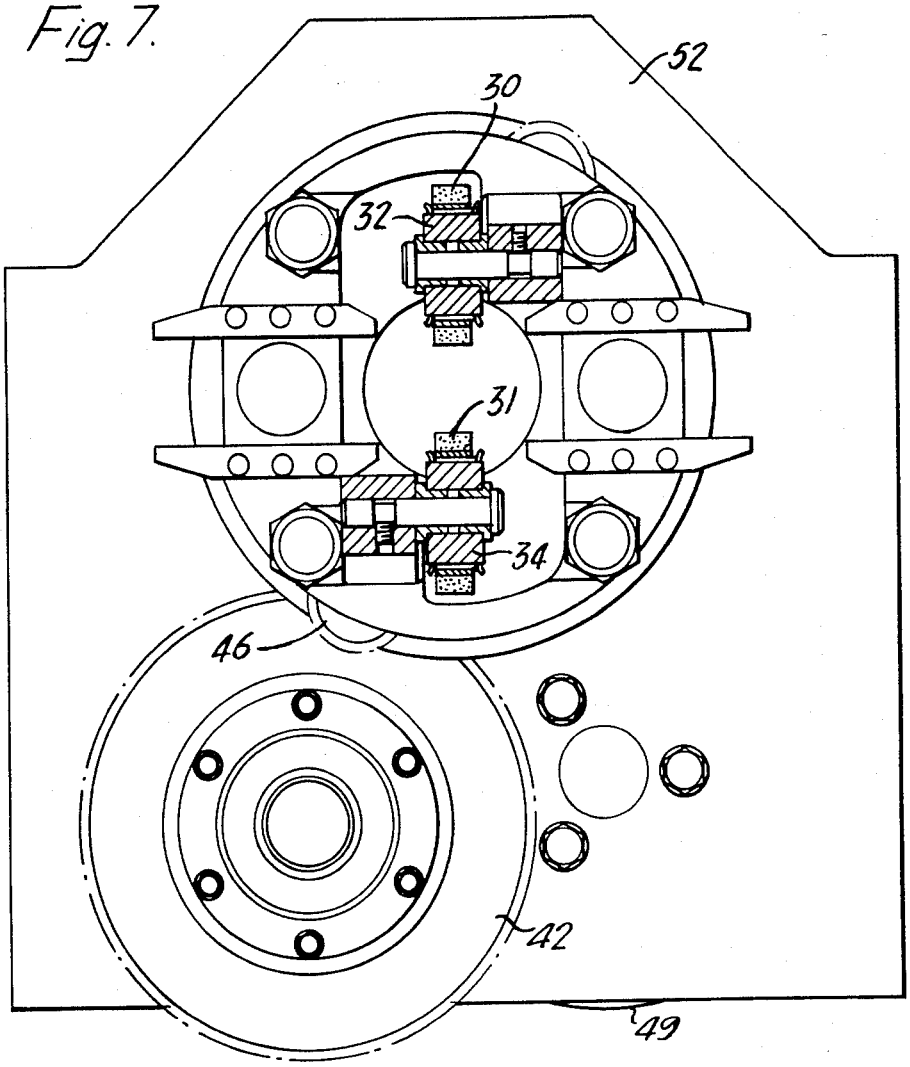
FIG. 7 is a sectional view on the line 7—7 of FIG. 6.
Figure 8:
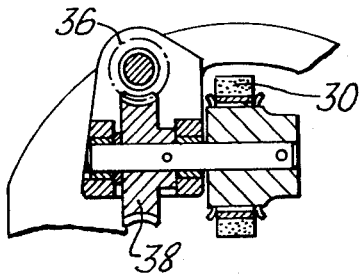
FIG. 8 is a sectional view on the line 8—8 of FIG. 6.

The support belt 25 carries the articles and tube to a twisting and severing station generally indicated at 28 and which will be described in detail in connection first of all with FIGS. 6, 7 and 8.

At the twisting and severing station 28, there are provided two conveying means 29 in the form of endless belts 30 and 31. The belt 30 is above the tube and the belt 31 below it when the twisting mechanism is in its rest position as illustrated in the drawings. The belt 30 passes over pulleys 32 and 33 and the belt 31 passes over pulleys 34 and 35. The belts 30 and 31 themselves are similar in construction to the belts 19 and 20 previously referred to in that they have soft foam rubber faces which frictionally grip the sides of the tube but do not grip hard enough to damage the easily compressible contents therein. The pulleys 33 and 35 are driven by worms 36 and 37 respectively (see FIG. 8) which drive worm wheels 38 and 39 respectively. Worms 36 and 37 are driven by belt 40 on pulley 41 connected to gear 42 in mesh with gear 43. This rotates sun gear 44 in mesh with planet gears 45 and 46 which drive the worms 36 and 37 respectively. Thus by continued movement of belt 40, the worms 36 and 37 are driven so as continuously to drive the conveyor belts 30 and 31.

The twisting and severing means also includes an indexing mechanism to rotate the entire twisting and severing means through one complete revolution. To achieve this there is provided an indexing sprocket 47 which is driven by chain 48 and which is coupled to gear 49. This gear 49 is in mesh with gear 50 connected to bearing tube 51 which rotates within frame 52 in bearings 53. The bearing tube 51 is coupled to face plate 54 on which the belts 30 and 31 are mounted. Thus, when indexing takes place, the entire mechanism 29 will rotate in the same direction as the rotation of sun wheel 44 and with similar peripheral speeds and hence the rotation of planet wheels 45 and 46 about sun wheel 44 due to their relative rotation will cease. Hence the drive of belts 30 and 31 will cease. The reason for this cessation in feed at the twisting and severing station will be explained later.

Figure 6:
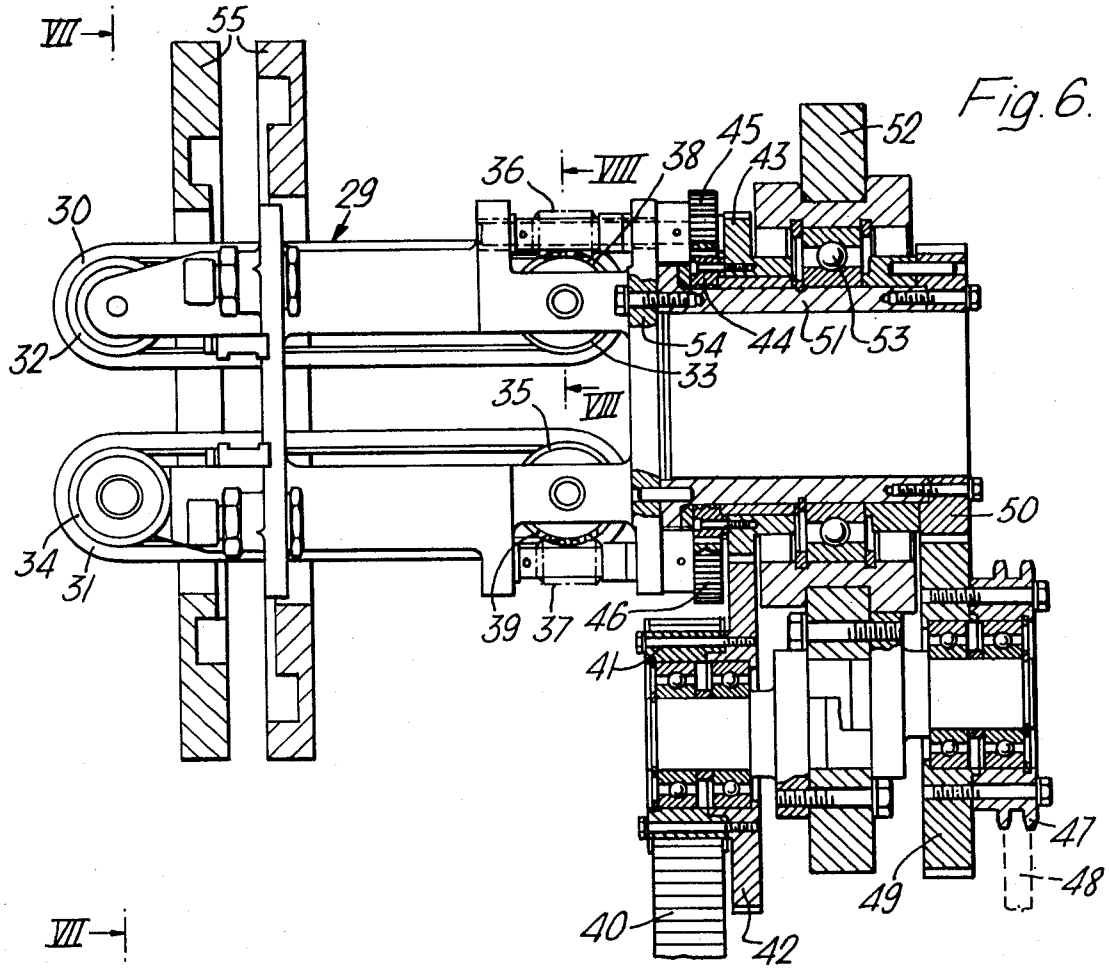
FIG. 6 is a longitudinal sectional view of the twisting and severing station which forms part of the apparatus of the invention.
Figure 9:
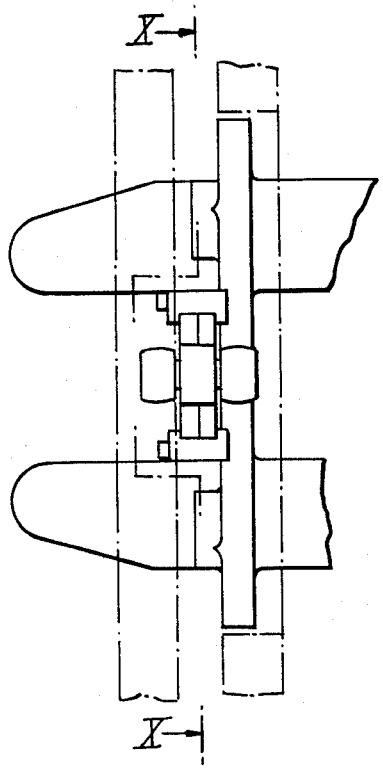
FIG. 9 is a side elevation of the severing mechanism according to the invention.
Figure 10:
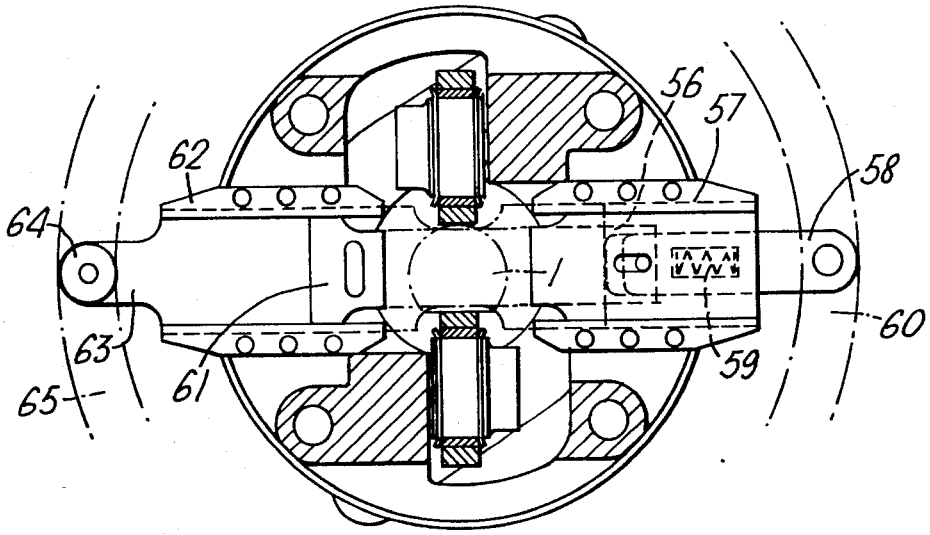
FIG. 10 is a cross sectional view on the line 10—10 of FIG. 9.

The severing mechanism is mounted on a nonrotatable part of the framework indicated at 55 in FIG. 6, and is indicated in detail in FIGS. 9 and 10. A knife or blade 56 is provided and is carried by a knife holder 57. The knife 56 is attached to an arm 58 loaded by spring 59 to the outward position and the outer end of arm 58 carries a cam follower which operates within a cam track 60. This cam track 60 is in the rotating part of the twisting and severing means so that on rotation thereof the knife will be operated.

Diametrically opposite the knife is an anvil 61. carried by an anvil holder 62. The anvil is mounted on an arm 63 having at its outer end cam follower 64. In a similar manner this cam follower 64 operates in cam track 65 forming part of the rotating mechanism of the twisting and severing means.

Figure 11:
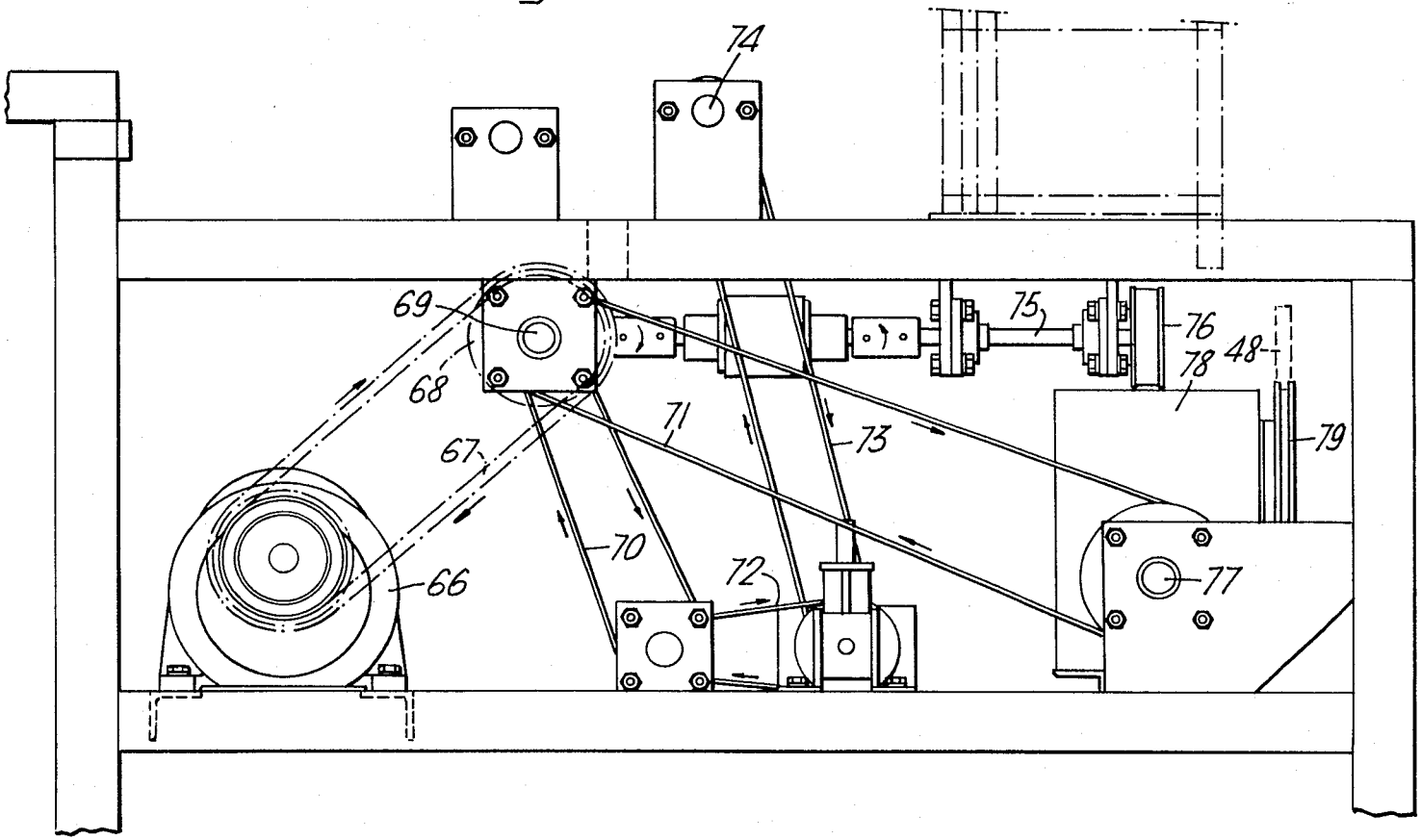
FIG. 11 is a side elevation of the drive mechanism of the apparatus according to the invention.

Referring now to FIG. 11 which shows the drive mechanism, there is provided a prime mover 66 in the form of an electric motor driving through chain 67 a sprocket 68 which turns shaft 69. Mounted on this shaft 69 are further sprockets which drives chains 70 and 71. The chain 70 drives chain 72 and then chain 73 which drives shaft 74. Shaft 69 drives shaft 75 which turns pulley 76 for giving the continuous rotation to the belts of the twisting mechanism. Chain 71 turns shaft 77 which operates the manifold index 78 to drive sprocket 79. This sprocket 79 drives chain 48 previously mentioned.

Figure 12:
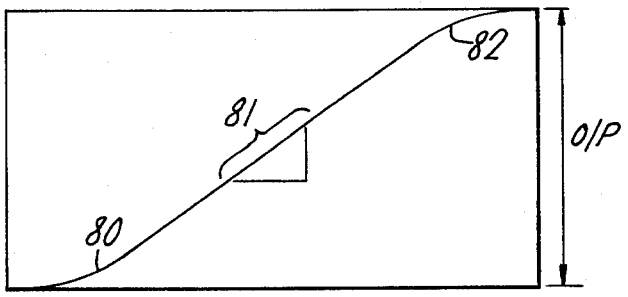
FIG. 12 is an illustration of the cam profile of the manifold indexer according to the invention.

The manifold indexing brought about by unit 78 is in the form indicated in FIG. 12. The horizontal axis in FIG. 12 indicates the degrees of rotation of the twisting and severing means and the vertical axis indicates the output of the unit 78. It will be seen that during the indexing rotation, the speed of rotation gradually builds up at 80 and in the centre section 81 is constant only to fall away again to a stationary position during the rotation period 82. It is during this central period indicated at 81 that the severing mechanism operates.

Referring back to FIGS. 1 and 2, it will be noted that the distance between adjacent articles is A prior to the articles and tube reaching the station 28. The articles and tube are continuously fed by the belt 25 and into the mechanism 28 until such time as the index mechanism operates. The belts 30 and 31 are then held stationary so that article 83 is prevented from moving forward. The succeeding article 84 continues to move and hence the gap between articles 83 and 84 shortens to distance B. During this time, the twisting movement has taken place and this shortening of the distance between the articles allows the tube to be twisted without breaking. As soon as the indexing has completed its revolution, the belts 30 and 31 are again moved until such time as article 83 reaches the position of article 85. When this occurs, then the indexing mechanism will operate once more and the severing means will operate and sever article 85 from its preceding article. The completely wrapped and severed articles are now discharged from the end of the apparatus at 86.

I claim:

1. A method of wrapping fragile or easily collapsible articles in foil, which includes continuously passing articles in spaced succession along a track, laying foil continuously over the articles to pass along the tracks therewith, continuously passing the articles and foil beneath a folding plate which forms the foil into a tube surrounding the articles, continuously feeding the articles and tube to a twisting and severing stations, arresting the forward motion of that article and its portion of surrounding tube which has entered the twisting and severing station, rotating said arrested article and its surrounding tube portion about the main axis of the tube to form a twist in the tube between that article and the succeeding article, the continuous feed of the other of said articles downstream of said arrested article causing the gap between said arrested article and said succeeding article to diminish during said rotating step, and thereafter severing said twist with a knife; and repeating said twisting and severing of the tube between successive articles.

2. The method as claimed in claim 1, including conveying the articles and surrounding tube to the twisting and severing station centrally along the track by a pair of resilient belts.

3. The method as claimed in claim 1, including the step of moving said arrested article and the surrounding tube portion substantially the length of one article relative to said twisting station after it is rotated to form said twist, and then performing said severing step on said twist while the surrounding article is rotated to form the next twist, said arrested article and said succeeding article being held stationary to one another during said severing step.

4. Apparatus for wrapping fragile or easily collapsible articles in foil, including a slideway on which articles may be placed, first conveying means associated with the slideway for moving articles in spaced succession therealong, a folding plate located adjacent the slideway, said plate forming the foil into a tube surrounding the articles as the foil and articles proceed along the slideway, a twisting means for receiving and arresting an article and its surrounding tube portion and for twisting the same while arrested about the main axis of said tube to form a twist in said tube between said received article and the succeeding article, second conveying means for continuously moving articles and said surrounding tube to said twisting means so that while one article is arrested by said twisting means the gap between said arrested article and the succeeding article is dimished as a result of said continuous movement, and severing means for severing said tube at said twist.

5. Apparatus as claimed in claim 4, in which said twisting means comprises a rotatable twisting head, a pair of belts mounted in said twisting head one on top and one below said tube when said twisting head is at rest, and means for cyclically causing index rotation of said twisting head through a complete revolution.

6. Apparatus as claimed in claim 5, in which said twisting head carries a drive mechanism for driving said belts, a prime mover, and drive means continuously driven by said prime mover and located between said prime mover and said drive mechanism, said drive means including a sun gear extending around said twisting head and attendant planet gears drivingly connected with said belts whereby said belts are driven while said twisting head is stationary and whereby said belts are nondriven during index rotation of said twisting head.

7. Apparatus as claimed in claim 6, in which said means for causing index rotation of said twisting head includes an indexing unit having an input shaft driven continuously by said prime mover and an output shaft, and means drivingly connecting said output shaft of said indexing unit to said twisting head to rotate said twisting head in response to rotation of said output shaft, said indexing unit being such that during each indexing rotation of said twisting head the rotational speed of said twisting head first gradually increases then is constant for some time and then gradually diminishes.

8. Apparatus as claimed in claim 7, in which said severing means includes a knife and an anvil mounted to move into a severing position from opposite sides of said twist in said tube, said movement of said knife and anvil into said severing position occurring during said time at which said speed of said twisting head is constant.

9. Apparatus as claimed in claim 4, in which said slideway is a horizontal elongate member with a longitudinal central slot, and said first conveyor means for moving articles in succession is a drive endless chain and a plurality of dogs carried by said chain and spaced uniformly along its length, said dogs projecting through said slot and abutting the trailing ends of articles.

10. Apparatus as claimed in claim 4, in which said second conveying means is a pair of belts one on each side of said tube, said belts having resilient faces which frictionally engage said tube and move said same along the slideway.

11. Apparatus as claimed in claim 4, in which said folding plate has an upstream profiled opening through which passes the articles together with foil laid continuously over the articles and downstram two lower fingers which overlap to form the foil into a tube surrounding the article.

* * * * *